US007036817B2

(12) United States Patent
Oliva

(10) Patent No.: US 7,036,817 B2
(45) Date of Patent: May 2, 2006

(54) METHOD OF PLAY AND GAME SURFACE FOR A DICE GAME

(75) Inventor: Anthony Oliva, Howard Beach, NY (US)

(73) Assignee: Action Gaming, LLC, Deer Park, NY (US)

( * ) Notice: Subject to any disclaimer, the term of this patent is extended or adjusted under 35 U.S.C. 154(b) by 0 days.

(21) Appl. No.: 10/364,542

(22) Filed: Feb. 11, 2003

(65) Prior Publication Data

US 2004/0155401 A1 Aug. 12, 2004

(51) Int. Cl.
*A63F 9/04* (2006.01)

(52) U.S. Cl. ..... 273/146; 273/274; 273/292

(58) Field of Classification Search ..... 273/146, 273/138 R, 292, 274, 309
See application file for complete search history.

(56) References Cited

U.S. PATENT DOCUMENTS 4,902,019 A * 2/1990 Berman ..... 273/256
5,542,671 A * 8/1996 Stewart ..... 273/146
5,662,330 A * 9/1997 Spears ..... 273/274
5,758,878 A * 6/1998 Brown ..... 273/274
5,788,239 A * 8/1998 Kong ..... 273/274
D402,330 S * 12/1998 White ..... D21/362
5,931,471 A * 8/1999 Bonito ..... 273/274
5,964,463 A * 10/1999 Moore, Jr. ..... 273/274
5,997,000 A * 12/1999 Nakano et al. ..... 273/274
6,299,531 B1 * 10/2001 Bommarito ..... 463/12
RE37,588 E * 3/2002 Ornstein ..... 273/292
6,378,869 B1 * 4/2002 Hedge et al. ..... 273/274
6,422,563 B1 * 7/2002 Fairchild et al. ..... 273/274
6,435,505 B1 * 8/2002 Hoffman ..... 273/274
6,464,225 B1 * 10/2002 Webb ..... 273/274
6,467,770 B1 * 10/2002 Matosevic ..... 273/274
6,648,756 B1 * 11/2003 Moody ..... 463/18
2001/0022430 A1 * 9/2001 Promutico ..... 273/274
2001/0042960 A1 * 11/2001 Lewis et al. ..... 273/274
2002/0017757 A1 * 2/2002 Marchesani ..... 273/274
2002/0084587 A1 * 7/2002 Bennett et al. ..... 273/309
2003/0067116 A1 * 4/2003 Colton ..... 273/274

(Continued)

OTHER PUBLICATIONS

John Scarne, Scarne's Encyclopedia Of Games, 1973, Harper & Row, pp. 454-466.*

(Continued)

*Primary Examiner*—Eugene Kim
*Assistant Examiner*—Dolores R. Collins
(74) *Attorney, Agent, or Firm*—Collard & Roe, P.C.

(57) ABSTRACT

A method and system for playing a dice game using a pair of dice. A primary player is first established. At least one wagers is then made from each player that one of a plurality of events will occur with the roll of the dice. The primary player then rolls the pair of dice. The wagers are then resolved based on each roll of the dice. Every roll of the dice presents a win/lose factor permitting players' wagers to be resolved with each roll. The game includes a playing surface for playing the game using a pair of dice, chips and a stick. The playing surface has a central area for all wagers that the result on the dice will be a seven, a first surrounding area around said central area for all wagers that the roll of the dice will result in a number greater than seven, and a second surrounding area around said central area for all wagers that the roll of the dice will result in a number less than seven.

7 Claims, 1 Drawing Sheet

U.S. PATENT DOCUMENTS

2004/0000755 A1* 1/2004 Cherven ..... 273/146

OTHER PUBLICATIONS

Vegas Web World's Guide To Dice (Craps)-http:/www.vegaswebworld.com/casino/dice.html.*

Online-Craps.net—http//www.online-craps.net/how_to_play_craps_rules.html.*

Over and Under Seven http://members.aol.com/dicetalk/rules/undover7.txt (Original Publication date Unkown).

* cited by examiner

METHOD OF PLAY AND GAME SURFACE FOR A DICE GAME

BACKGROUND OF THE INVENTION

The invention relates to a method and game surface for playing a dice game. More particularly, a dice game that provides multiple wagering options and has a win/lose factor with each roll of the dice.

U.S. Pat. No. 5,964,463 to Moore, Jr. discloses a method of playing a dice game, while U.S. Pat. No. 6,464,255 B1 to Webb discloses a method and apparatus for playing a dice game both incorporated herein by reference. The present invention provides an improved method of playing a dice game and an improved gaming surface. The present invention has a win/lose factor with each roll of the dice as well as original wagering and simple rules so that the game may be picked up easily by a novice gambler.

SUMMARY OF THE INVENTION

The present invention includes a method of playing a dice game using a pair of dice. A primary player is first established and at least one wager is made from each player. The players wager that one of a plurality of events will occur with the roll of the dice. The primary player then rolls the pair of dice. The wagers are then resolved, losing wagers are collected, while winning wagers are paid according to the payout of the designated area of the gaming surface. Every roll of the dice presents a win/lose factor permitting players' wagers to be resolved with each roll.

A new primary player is established if the wager of the primary player results in a loss. A primary player remains the primary player if his/her wager results in a win.

A wager that the rolled dice will amount to seven pays 4:1 if a seven is rolled. A wager that the rolled dice will amount to a number less than seven pays 1:1 if a number less than seven is rolled. A wager that the rolled dice will amount to a number greater than seven pays 1:1 if a number greater than seven is rolled. A wager that the rolled dice will amount to an even number pays 1:1 if an even number is rolled. A wager that the rolled dice will amount to an odd number pays 1:1 if an odd number is rolled. A wager that the rolled dice will amount to three or eleven pays 7:1 if a three or eleven is rolled. A wager that the rolled dice will amount to a two or twelve pays 15:1 if a two or twelve is rolled.

The game includes a playing surface for playing the game using a pair of dice, chips and a stick. The playing surface has a central area designated for all wagers that the result on the dice will be a seven. This central area is encircled by a first surrounding area designated for all wagers that the roll of the dice will result in a number greater than seven, and a second surrounding area designated for all wagers that the roll of the dice will result in a number less than seven.

The playing surface further includes a first peripheral area on the periphery of the central area designated for all wagers that the roll of the dice will result in an odd number, and a second peripheral area on the periphery of the central area designated for all wagers that the roll of the dice will result in an even number.

BRIEF DESCRIPTION OF THE DRAWING

Other objects and features of the present invention will become apparent from the following detailed description considered in connection with the accompanying drawing. It is to be understood, however, that the drawing is designed as an illustration only and not as a definition of the limits of the invention.

The FIGURE shows a playing surface for the dice game preferably entitled "Dicetown."

DETAILED DESCRIPTION OF THE PREFERRED EMBODIMENT

Figure 1:
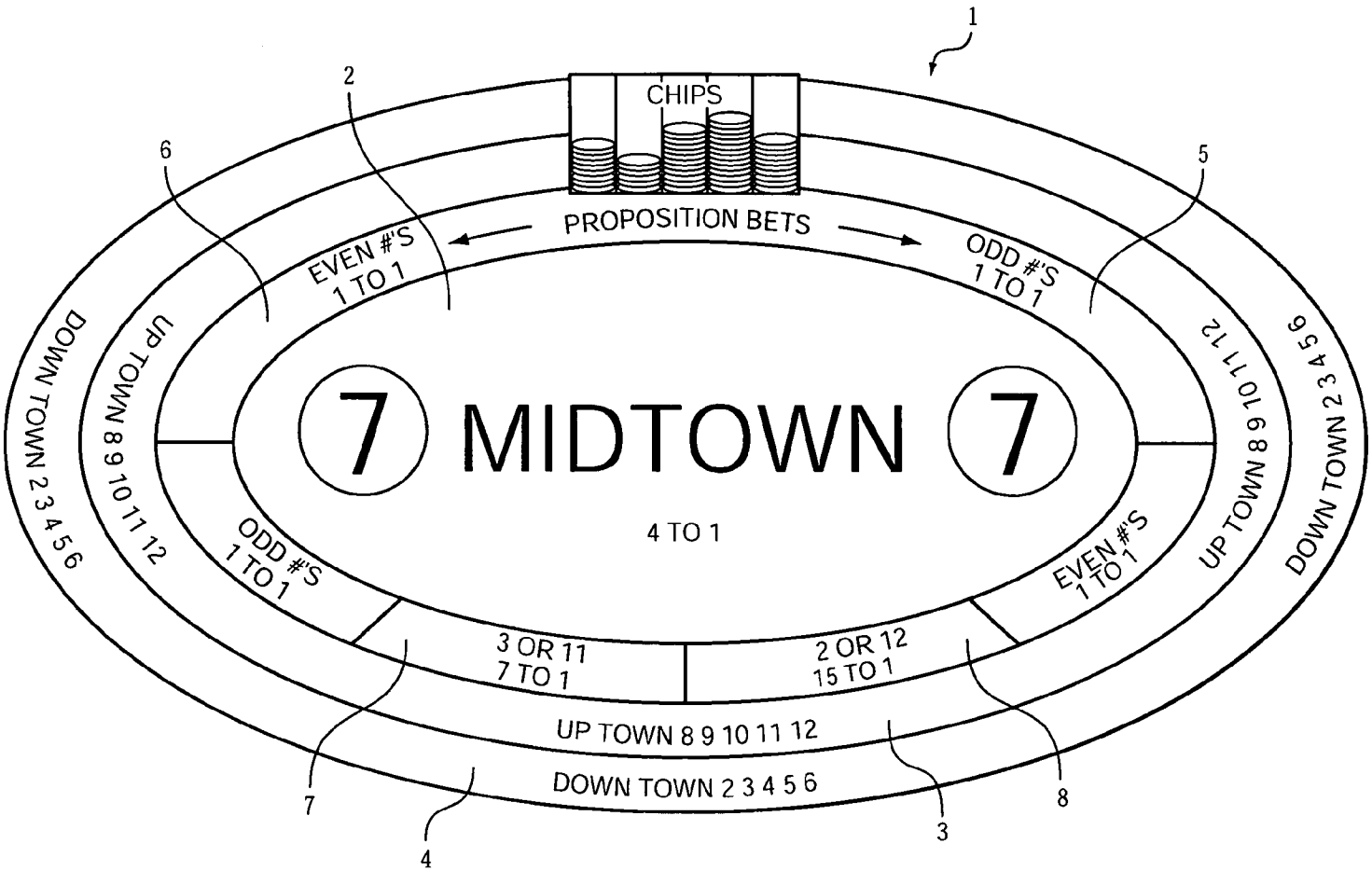

Referring in detail to the drawing, the FIGURE shows a playing surface 1 for a dice game preferably entitled "Dicetown." Playing surface 1 has a central area 2 designated for all wagers that the result on the dice will be a seven. A first surrounding area 3 around central area 2 is designated for all wagers that the roll of the dice will result in a number greater than seven, and a second surrounding area 4 around central area 2 is designated for all wagers that the roll of the dice will result in a number less than seven.

Playing surface 1 further includes a first peripheral area 5 on the periphery of central area 2 designated for all wagers that the roll of the dice will result in an odd number. A second peripheral area 6 on the periphery of central area 2 is designated for all wagers that the roll of the dice will result in an even number.

Playing surface 1 further includes a third peripheral area 7 on the periphery of central area 2 designated for all wagers that a roll of the dice will result in a three or an eleven. A fourth peripheral area 8 on the periphery of central area 2 is designated for all wagers that a roll of the dice will result in a two or a twelve.

In playing the dice game on gaming surface 1, a primary player is first established as the player that will roll the dice. At least one wager is then placed by all the players on any of the designated areas of gaming surface 1. The primary player then rolls the dice on gaming surface 1 and the resulting number is read. Losing wagers are collected by the house from gaming surface 1. Winning wagers are paid according to the pay-outs of the specific spot on which the wager was placed.

If the primary player won on the first roll, he/she continues as the primary player. If the primary player lost on the first roll, a new primary player is selected. The new primary player may be the player to the left of the previous primary player. Play then continues with wagers being made by all the players and dice being rolled for a second time.

A roll of 7 results in a winning wager on central area 2 which is paid 4:1 by the house. A roll of a number greater than seven results in a winning wager on first surrounding area 3 which is paid 1:1 by the house. A roll of a number less than seven results in a winning wager on second surrounding area 4 which is paid 1:1 by the house. A roll of an odd number results in a winning wager on first peripheral area 5 which is paid 1:1 by the house. A roll of an even number results in a winning wager on second peripheral area 6 which is be paid 1:1 by the house. A roll of a three or eleven results in a winning wager on third peripheral area 7 which is be paid 7:1 by the house. A roll of a two or twelve results in a winning wager on fourth peripheral area 8 which is be paid 15:1 by the house.

For example if a wager was placed on every possible spot of gaming surface 1, and a 12 was rolled, wagers on first surrounding area 3 would be paid 1 to 1, wagers on second peripheral area 6 would be paid 1 to 1, and wagers on fourth peripheral area 8 would be paid 15 to 1. The remaining wagers would be collected by the house.

Accordingly, while one embodiment of the present invention has been shown and described, it is obvious that many changes and modifications may be made thereunto without departing from the spirit and scope of the invention.

What is claimed is:

1. A gaming surface for playing a game using a pair of dice, chips and a stick, the gaming surface comprising:

a central area for all wagers that the dice roll will be a seven;

a first surrounding area around said central area for all wagers that the dice roll will be a number greater than seven;

a second surrounding area around said central area for all wagers that the dice roll will be a number less than seven;

a first peripheral area on a periphery of said central area for all wagers that the dice roll will be an odd number; and a second peripheral area on said periphery of said central area for all wagers that the dice roll will be an even number.

2. The table for playing a game using a pair of dice according to claim 1, further comprising a third peripheral area on said periphery of said central area for all wagers that the dice roll will be a three or an eleven.

3. The table for playing a game using a pair of dice according to claim 2, further comprising a fourth peripheral area on said periphery of said central area for all wagers that the dice roll will be a two or a twelve.

4. The table for playing a game using a pair of dice according to claim 1, wherein said central area is labeled "midtown."

5. The table for playing a game using a pair of dice according to claim 1, wherein said first surrounding area is labeled "uptown."

6. The table for playing a game using a pair of dice according to claim 1, wherein said second surrounding area is labeled "downtown."

7. The table for playing a game using a pair of dice according to claim 3, wherein said central area, said first surrounding area, said second surrounding area, said first peripheral area, said second peripheral area, said third peripheral area, and said fourth peripheral area are each labeled with respective pay-outs.

* * * * *